US010591235B2

(12) United States Patent
Michlin

(10) Patent No.: US 10,591,235 B2
(45) Date of Patent: Mar. 17, 2020

(54) COLLET CHAMBER FOR WEAPONS

(71) Applicant: U.S. Army Research Laboratory, Adelphi, MD (US)

(72) Inventor: Alex Michlin, Whiteford, MD (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 284 days.

(21) Appl. No.: 15/451,542

(22) Filed: Mar. 7, 2017

(65) Prior Publication Data

US 2019/0017764 A1 Jan. 17, 2019

(51) Int. Cl.
*F41A 21/12* (2006.01)
*F41A 15/14* (2006.01)

(52) U.S. Cl.
CPC ..... *F41A 15/14* (2013.01); *F41A 21/12* (2013.01)

(58) Field of Classification Search
CPC ..... F42B 8/10; F41A 21/10; F41A 21/12
USPC ..... 42/77; 102/447, 446, 520–522
See application file for complete search history.

(56) References Cited

U.S. PATENT DOCUMENTS 631,399 A * 8/1899 Gillette ..... F41A 21/10 42/77
1,180,760 A * 4/1916 Burnaman ..... F41A 21/10 42/77
1,555,854 A * 10/1925 Hill ..... F41A 21/10 102/430
3,235,996 A * 2/1966 Maillard ..... F41A 21/12 42/76.01
3,793,922 A * 2/1974 Angell ..... F41A 3/36 89/180

* cited by examiner

*Primary Examiner* — Reginald S Tillman, Jr.
(74) *Attorney, Agent, or Firm* — Alan I. Kalb

(57) ABSTRACT

A system for reducing an extraction force required for removing a spent munition cartridge case from a weapon after firing, the system including a chamber; and a plurality of movable components in the chamber that are configured to radially expand with a corresponding expansion of a fired munition cartridge case, wherein radial expansion of the plurality of movable components causes a rearward force on the plurality of movable components and the spent munition cartridge case. The chamber may include a tapered wall, and the plurality of movable components may matingly align with the tapered wall. The plurality of movable components may align with one another. Each movable component may include a tapered outer surface comprising an angle greater than an angle of an outer surface of a pre-fired cartridge case.

3 Claims, 15 Drawing Sheets

COLLET CHAMBER FOR WEAPONS

GOVERNMENT INTEREST

The embodiments herein may be manufactured, used, and/or licensed by or for the United States Government without the payment of royalties thereon.

BACKGROUND

Technical Field

The embodiments herein generally relate to weapons, and more particularly to techniques for improving extraction of spent munition cartridge casings from a weapon after firing.

Description of the Related Art

Cartridge case pressures are being increased in ammunition to provide better performance. A commonly used method to help with cartridge case extraction is the use of a fluted chamber, which is actively used in several platforms including rifles. Fluting a chamber includes creating channels on the surface of the chamber that allow for combustion gasses to flow around the outside of the cartridge case. Combustion gases equalize the pressure difference across the cartridge case, reducing the permanent radial expansion that causes difficult cartridge case extraction. Fluted chambers deposit a tremendous amount of soot due to the combustion gasses on internal surfaces of the weapon and the spent cartridge case, which can lead to weapon malfunctions and stoppages as the soot builds up in the weapon. Another downside of the fluted chamber is that the flutes can only extend from the cartridge mouth to part-way down the chamber. The flutes need to stop near the base of the cartridge so the non-fluted section can provide a gas seal. Especially in higher pressure cartridges, swelling in the base of the cartridge provides a substantial preload on the chamber and thus, much greater extraction forces are required.

Other methods that help ease cartridge case extraction are the use of lubricants or lubricant plating/films on the ammunition and/or chamber walls. These lubricants reduce the friction coefficients between the ammunition and chamber walls, thus, lowering the extraction force. These coatings have a limited lifetime due to the pressures and wear on the systems. The coatings tend to be cost prohibitive when used on ammunition and may present a danger to the gun/operator if used improperly.

Most all modern ammunition includes a cartridge case that contains propellant and a projectile. When the propellant is ignited and burns, gas pressure on the inside of the cartridge case increases and pushes outwards on the cartridge case walls. In order to prevent the cartridge case from rupturing, the gun barrel has a recess that is the shape of the cartridge case, which is called a chamber. FIG. 1 illustrates a cross-sectional view of a typical conventional chamber of a gun having a minimally angled chamber wall 90. This chamber supports the thin walls of the cartridge case preventing the case from rupturing. After the pressures subside within the cartridge case, the case material, usually a brass alloy, maintains a radial expansion due to the material yielding from the internal pressures. This radial expansion and any remaining gas pressure presses against the chamber walls, creating a normal force along the surface which creates the friction force during extraction. Previous methods of reducing this friction force typically rely on either reducing the normal force on the chamber walls (fluted chambers) or reducing the coefficient of friction.

SUMMARY

In view of the foregoing, an embodiment herein provides a collet chamber assembly for a weapon comprising a chamber comprising a tapered wall; and an insert comprising a plurality of independently movable components that matingly align with the tapered wall. The insert may progressively increase in perimeter size from a first end to a second end. The insert may comprise at least one longitudinal through slit creating the plurality of independently movable components. The insert may comprise a hole extending an entire length of the insert. The hole may be configured to accommodate a munition cartridge case. The insert may comprise a tapered outer surface comprising an angle greater than an angle of an outer surface of the munition cartridge case. The first end of the insert may be positioned towards a barrel of the weapon, and the second end of the insert may be positioned towards a rear portion of the chamber. The through split may be configured to permit the independently movable components to expand radially at a start of extraction of the munition cartridge case. The insert may be configured to radially expand. The insert may be configured to radially contract. Radial expansion of the insert causes a rearward force on the independently movable components. The collet chamber may comprise a back wall that abuts the insert.

Another embodiment provides a system for reducing an extraction force required for removing a spent munition cartridge case from a weapon after firing, the system comprising a chamber; and a plurality of movable components in the chamber that are configured to radially expand with a corresponding expansion of a fired munition cartridge case, wherein radial expansion of the plurality of movable components causes a rearward force on the plurality of movable components and the spent munition cartridge case. The chamber may comprise a tapered wall, and the plurality of movable components may matingly align with the tapered wall. The plurality of movable components may align with one another. Each movable component may comprise a tapered outer surface comprising an angle greater than an angle of an outer surface of a pre-fired cartridge case. The first end of the each movable component may be positioned towards a barrel of the weapon, and the second end of the each movable component may be positioned towards a rear portion of the chamber. A perimeter of the first end may be less than a perimeter of the second end. The chamber may comprise a back wall that abuts the plurality of movable components. The plurality of movable components may be configured to radially contract.

These and other aspects of the embodiments herein will be better appreciated and understood when considered in conjunction with the following description and the accompanying drawings. It should be understood, however, that the following descriptions, while indicating preferred embodiments and numerous specific details thereof, are given by way of illustration and not of limitation. Many changes and modifications may be made within the scope of the embodiments herein without departing from the spirit thereof, and the embodiments herein include all such modifications.

BRIEF DESCRIPTION OF THE DRAWINGS

The embodiments herein will be better understood from the following detailed description with reference to the drawings, in which.

DETAILED DESCRIPTION

The embodiments herein and the various features and advantageous details thereof are explained more fully with reference to the non-limiting embodiments that are illustrated in the accompanying drawings and detailed in the following description. Descriptions of well-known components and processing techniques are omitted so as to not unnecessarily obscure the embodiments herein. The examples used herein are intended merely to facilitate an understanding of ways in which the embodiments herein may be practiced and to further enable those of skill in the art to practice the embodiments herein. Accordingly, the examples should not be construed as limiting the scope of the embodiments herein.

Figure 1:
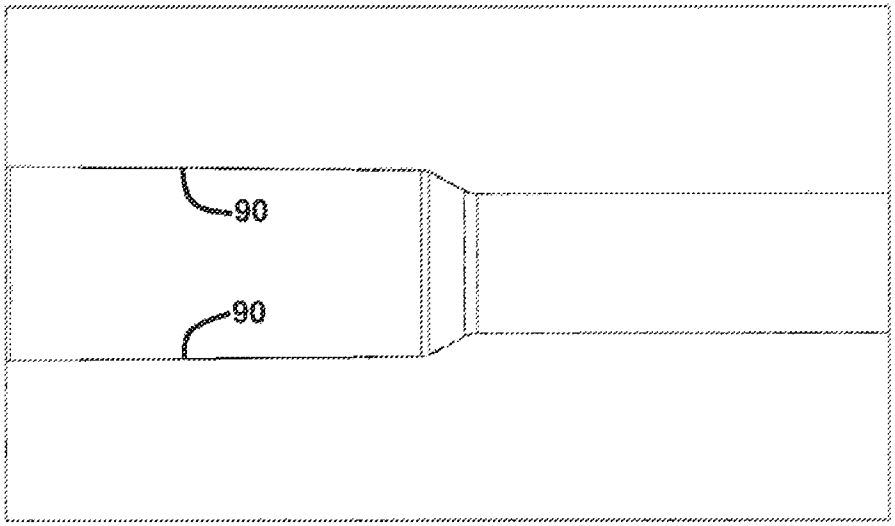
FIG. 1 (Prior Art)
FIG. 1 illustrates a cross-sectional view of a conventional chamber of a gun.
Figure 2:
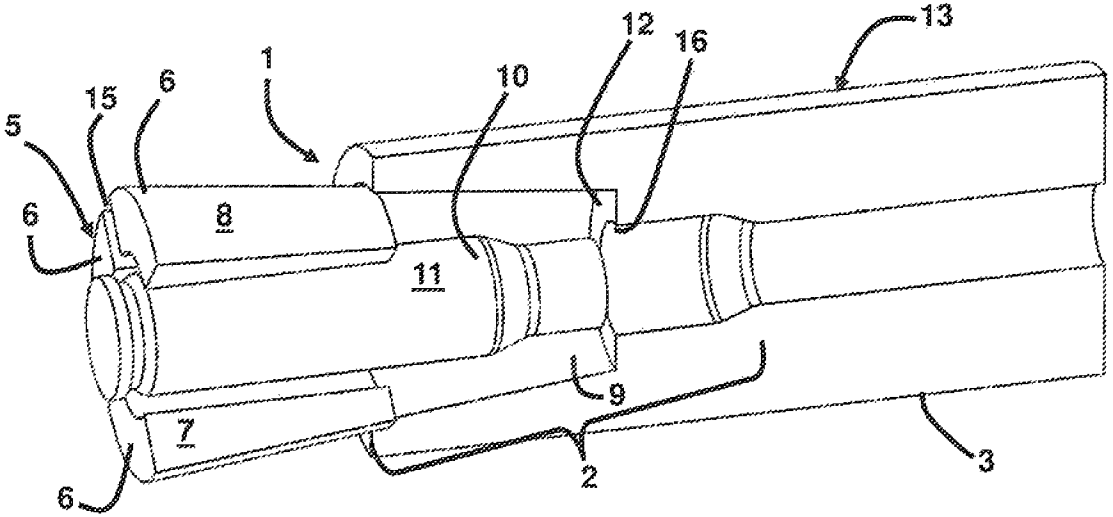
FIG. 2 illustrates a cut-away schematic diagram of an assembly during loading according to an embodiment herein.

The embodiments herein provide a chamber assembly and system containing an insert with movable components referred to herein as a collet chamber. Referring now to the drawings, and more particularly to FIGS. 2 through 8B, where similar reference characters denote corresponding features consistently throughout the figures, there are shown preferred embodiments. As shown in FIG. 2, the embodiments herein provide an assembly 1 comprising a collet chamber 2 for a weapon 13 such as small-arms rifles/carbines, among others, and includes an insert 5 comprising of movable wedges 6 in the rear 16 of the chamber 2 that facilitate the easier extraction of a spent ammunition cartridge case 10 compared to the typical conventional chamber shown in FIG. 1. The insert 5 may be truncated-cone shaped and contains longitudinal through slits or cuts 15, creating independent wedges 6 that can move during extraction. The wedges 6 can also be affixed to themselves by hinges or a flexing component (not shown) that still allow for radial expansion/flexing during extraction.

Since the wedges 6 have a greater angle taper than that of common cartridge cases 10, there is a greater force component assisting the extraction of the spent cartridges 10. In addition to the truncated-cone shape described above and shown in the drawings, other configurations are possible. For example, other possible configurations include a square truncated pyramid configuration, and generally any configuration that starts off at a larger perimeter and progresses to a smaller perimeter. Moreover, other viable configurations include a wedge to dome/hemisphere to multi-facet structure as well as elongated configurations such as parabolic shapes.

At least one cut 15 is provided to allow the wedges 6 of the insert 5 to expand and contract radially. The insert 5 can be inserted into the chamber 2 either as an aligned unit or as individual pieces 6. In some types of weapons, it may be easier to install the wedges 6 one at a time. Generally, the insert 5 would be installed at the time of gun manufacturing/maintenance. Since there is likely to be a barrel extension 25 (shown in FIGS. 6A and 6B) over the end of the barrel 3 that only allows the insert 5 to move a short distance, this prevents the insert 5 from shifting out of alignment with the bore of the barrel 3. This barrel extension 25 is a standard item, and has a standard method to lock the bolt to the barrel for firing (such as locking lugs (not shown, but known to those skilled in the art)).

The inner surface 7 of the wedges 6 comprise the same profile as typical chamber walls 90 (of FIG. 1) and provide a seamless chamber profile in which to support the cartridge case 10. The profile of the outer surface 8 of the wedges 6 are generally a straight smooth taper with an angle greater than the taper on the cartridge case 10, however, other profiles, such as a stepped taper, can be utilized. The insert 5 may be supported, but is not required to be (depending on the physical attributes including ammunition, friction coefficients, wedge angles, etc.) during firing by a bolt (not shown) of the weapon 13 or another mechanism to prevent premature rearward movement during firing.

Figure 3:
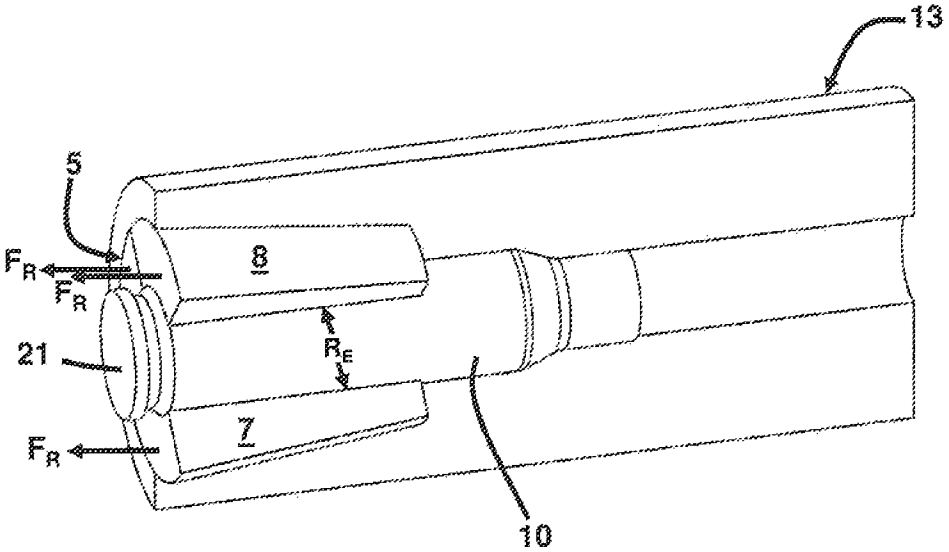
FIG. 3 illustrates a cut-away schematic diagram of an assembly after loading, during firing, and prior to cartridge case extraction according to an embodiment herein.

During loading of a cartridge case 10 into the chamber 2, the wedges 6 are moved fully forward as shown in FIG. 3 so the insert 5 abuts the front wall 12 (shown in FIG. 2, but hidden from view in FIG. 3), and supported by the bolt or another mechanism that prevents the wedges 6 and cartridge case 10 from moving rearward during firing. The insert 5 is configured to be part of the weapon 13 and to remain in the chamber 2 (although allowed to move from the fully inserted position slightly rearward during extraction, but otherwise remain in the gun 13). The cartridge case 10 is the only thing that is fully removed and a new cartridge is inserted after use. Both the new cartridge case 10 and insert 5 are moved forward into the locked position by the bolt face.

During the course of firing the cartridge case 10 (ignition), the cartridge case 10 swells and permanently deforms, which applies a radial force on the wedges 6 and chamber walls 9 (shown in FIG. 2, but hidden from view in FIG. 3). This radial force is transferred to the outside surface 8 of the wedges 6 at which point the barrel 3 or another part of the weapon 13 supports the wedges 6. The reaction from the support to this radial expansion force $R_E$ has a force component that applies a rearward force $F_R$ on the wedges 6 due to the angle of the outside surface 8.

Figure 4:
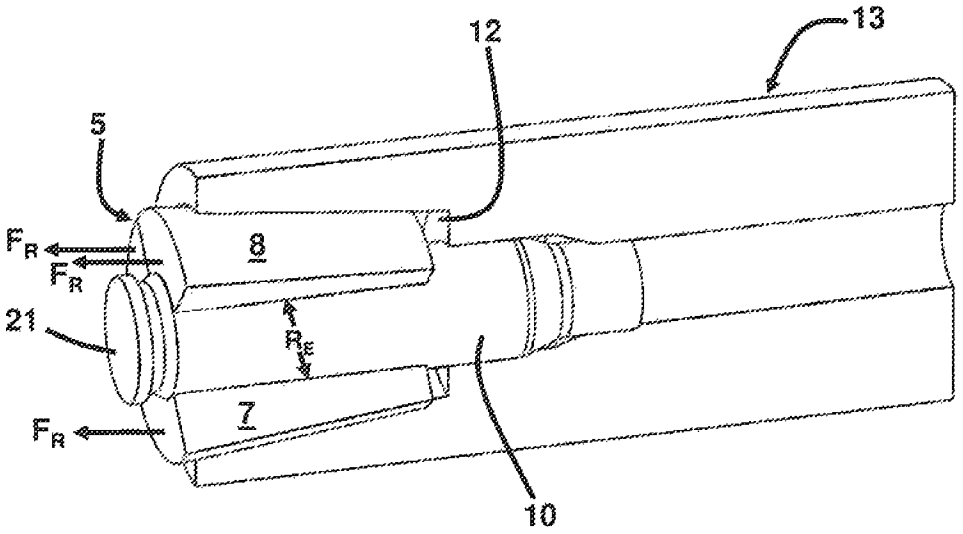
FIG. 4 illustrates a cut-away schematic diagram of an assembly during the initial stages of cartridge case extraction according to an embodiment herein.
Figure 5:
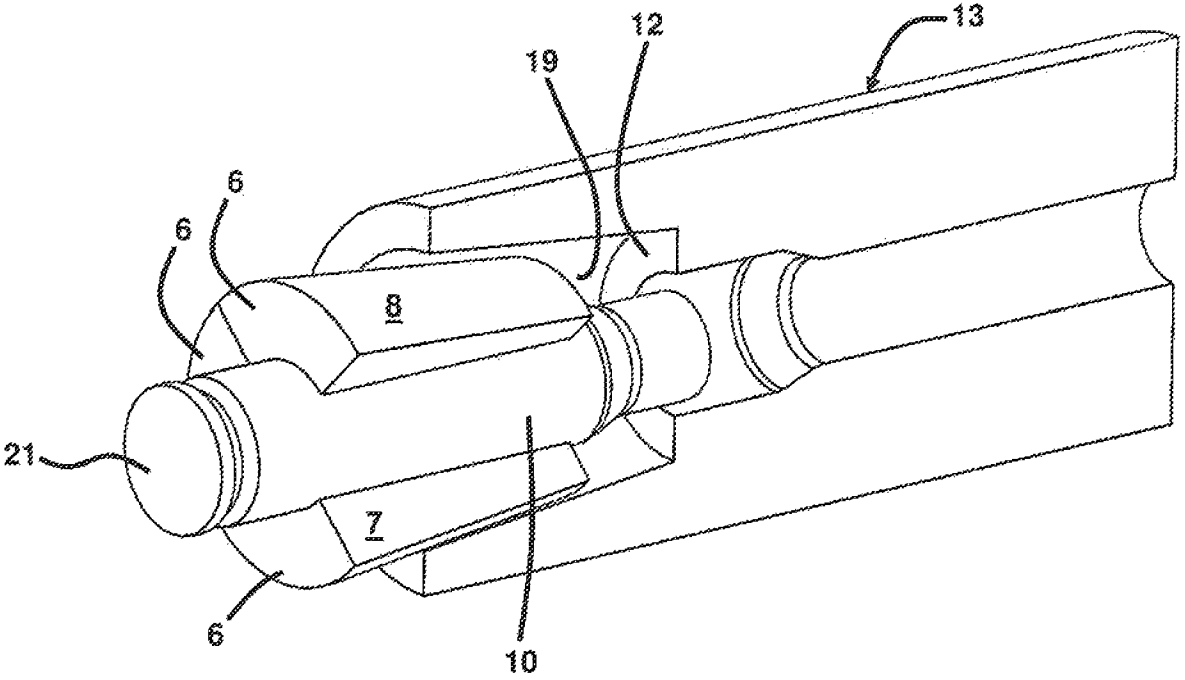
FIG. 5 illustrates a cut-away schematic diagram of a cross-sectional view of the assembly during cartridge case extraction according to an embodiment herein.
Figure 6A:
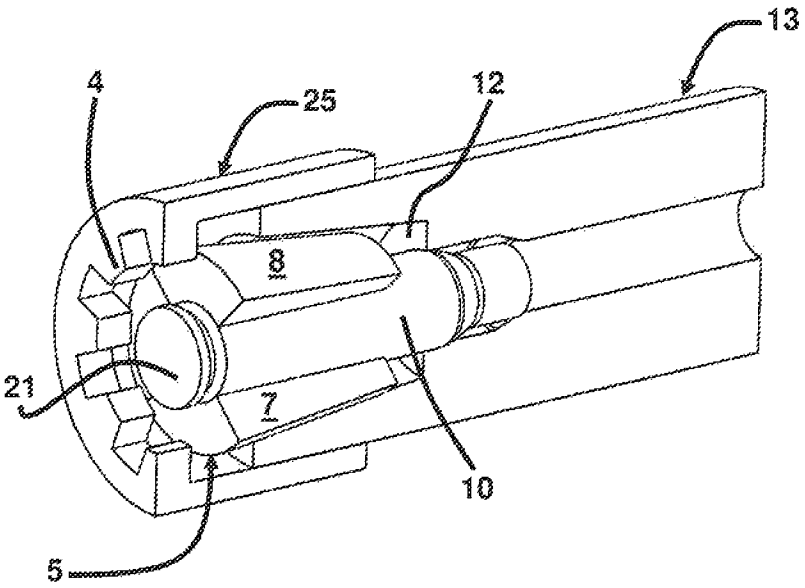
FIG. 6A illustrates a cut-away schematic diagram of an assembly before cartridge case extraction according to an embodiment herein.
Figure 6B:
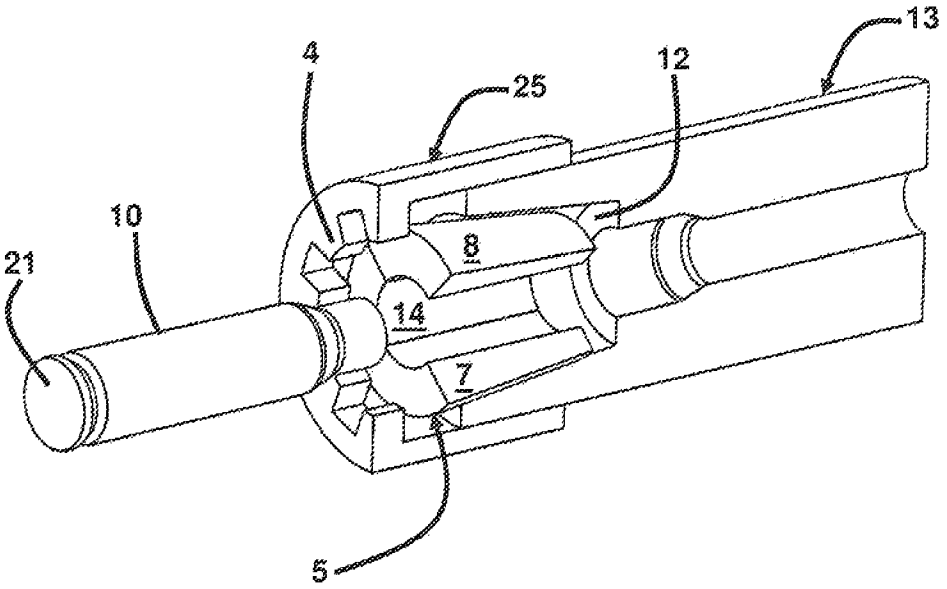
FIG. 6B illustrates a cut-away schematic diagram of an assembly after cartridge case extraction according to an embodiment herein.

During extraction, the support (not shown) preventing the cartridge case 10 and wedges 6 from moving (i.e., a gun bolt) is removed and a rearward force $F_R$ is applied by the cartridge extractor (not shown, but is generally configured as a hook-shaped part usually found on the bolt of in modern firearms) to the cartridge case 10 on the exposed groove of the cartridge case 10. Both the wedges 6 and cartridge case 10 move rearward in the direction of force $F_R$ as a single unit for a short distance due to friction force between the cartridge case 10 and the wedges 6, as shown in FIG. 4. The increased taper of the outer surface 8 of wedge 6 compared to the cartridge case 10 allows for the release of the cartridge case 10 radial expansion $R_E$ in a shorter rearward distance than the cartridge case 10 alone. Once the wedges 6 reach a pre-determined rearward stop 4 (shown in FIGS. 6A and 6B), the rearward movement is stopped. The stop 4 may be configured on the inside of the locking lugs on a typical barrel extension 25 or a protrusion from the gun frame. The cartridge case 10 continues rearward with the extractor, as shown in FIGS. 5 and 6B. The insert 5 and the cartridge case 10 are both held in place in the chamber 2 by the bolt face during firing. When the cartridge case 10 is extracted, the bolt face moves rearward. Generally, there is not enough force generated by the wedge effect of the insert 5 to overcome friction alone, so the wedges 6 and cartridge case 10 stay in place until the extractor applies a rearward force to the cartridge case 10. The insert 5 then moves a short distance rearward before being stopped by the barrel extension 25. Since the rearward force $F_R$ from the extractor is additive with the reaction force on the wedges 6, the total extraction force remains the same for the cartridge case 10, however, less force is required by the extractor.

Figure 7A:
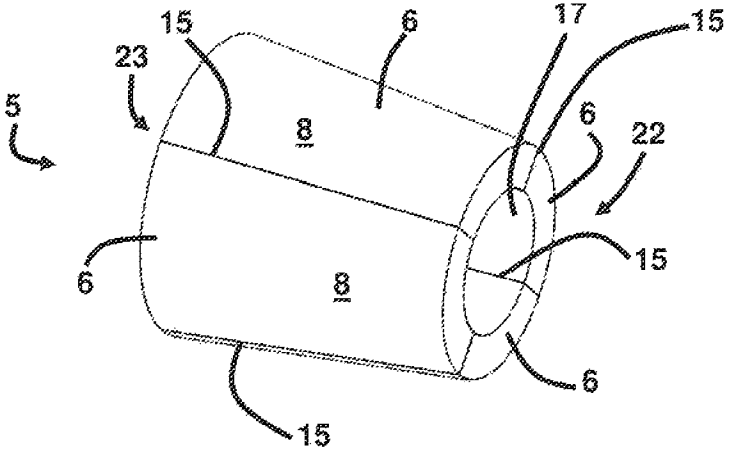
FIG. 7A illustrates a perspective view of an insert according to an embodiment herein.
Figure 7B:
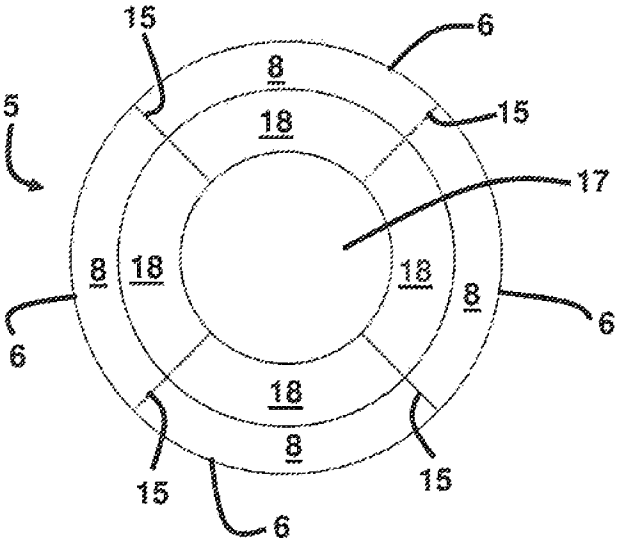
FIG. 7B is a front end view of the insert of FIG. 7A according to an embodiment herein.
Figure 7C:
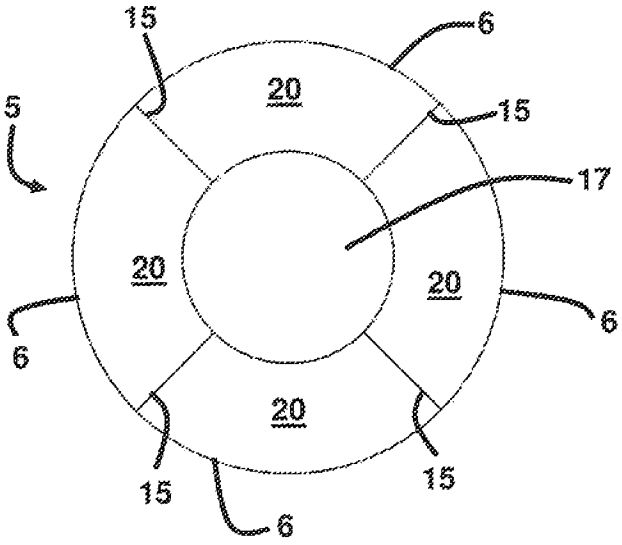
FIG. 7C is a rear end view of the insert of FIG. 7A according to an embodiment herein.
Figure 7D:
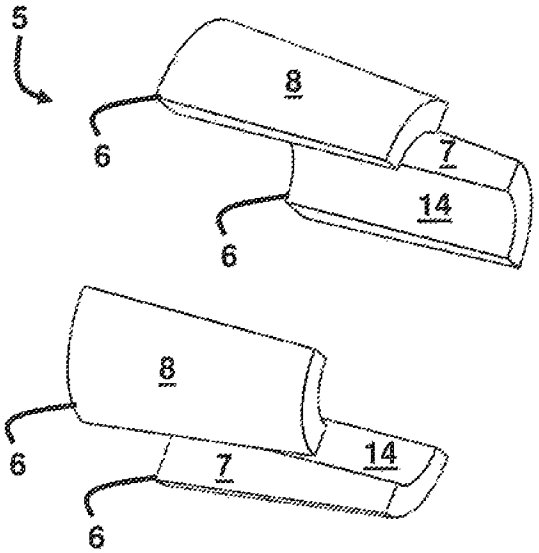
FIG. 7D is a perspective view of the separated components of the insert of FIG. 7A according to an embodiment herein.
Figure 7E:
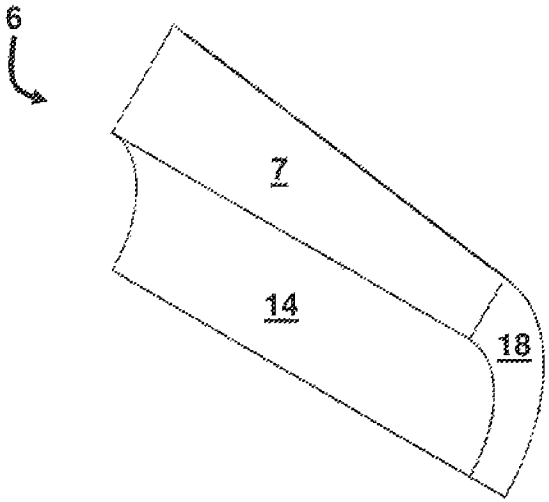
FIG. 7E is a perspective view of one independent component of the insert of FIG. 7A according to an embodiment herein.
Figure 7F:
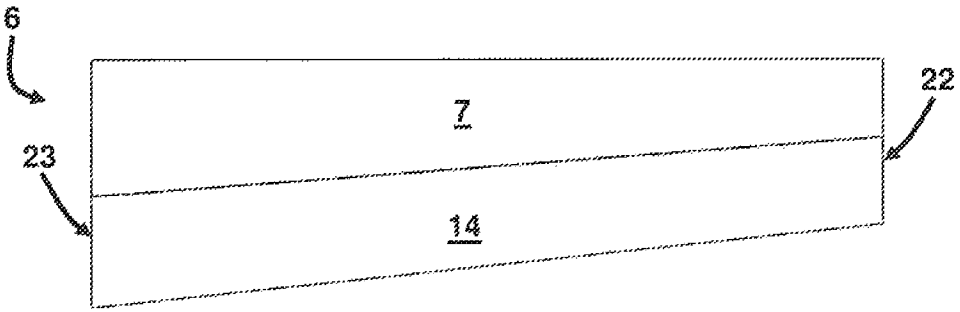
FIG. 7F is a side view of the inner surface of the independent component of FIG. 7E according to an embodiment herein.

FIGS. 7A through 7C, with reference to FIGS. 2 through 6B, illustrate the insert 5 with all of the wedges 6 aligned together. The aligned wedges 6 create a hole 17, which is the continuation of the profile of a typical chamber wall 90 (of FIG. 1), through which the cartridge case 10 may rest. The slits 15 can be configured such that there is a small segment left connected at one end such that the wedges 6 are still allowed to expand, but remain loosely attached to one another. FIG. 7B illustrates a front view of the insert 5 while FIG. 7C illustrates the rear view of the insert 5. Each wedge 6 further includes a front wall surface 18 and a rear wall surface 20, such that the front wall surface 18 abuts the front wall 12 of the chamber 2, and the rear wall surface 20 faces in an opposite direction from the front wall surface 18. FIG. 7D illustrates the separated wedges 6 of the insert 5. The outer surface 8 of each wedge 6 is configured to matingly align with the tapered recessed chamber wall 9 of the chamber 2. FIGS. 7E and 7F, with reference to FIGS. 2 through 7D, illustrate an individual wedge 6, and further illustrate the configuration of the inner surface 14 of a wedge 6, which contacts the cartridge case 10 and receives the expansion $R_E$ of the cartridge case 10 upon firing of the weapon 13. As indicated in FIGS. 7A through 7F, the insert 5 comprises a first end 22 and a second end 23, wherein the first end 22 of the insert 5 comprises the front wall surface 18 that abuts the front wall 12 of the chamber 2 and is positioned towards the barrel 3 of the weapon 13, and the second end 23 of the insert 5 comprises the rear wall surface 20 and faces in an opposite direction away from the barrel 3 and weapon 13. The perimeter of the insert 5 progressively increases from the first end 22 to the second end 23 such that the perimeter of the first end 22 of the insert 5 is less than perimeter of the second end 23 of the insert 5.

Figure 8A:
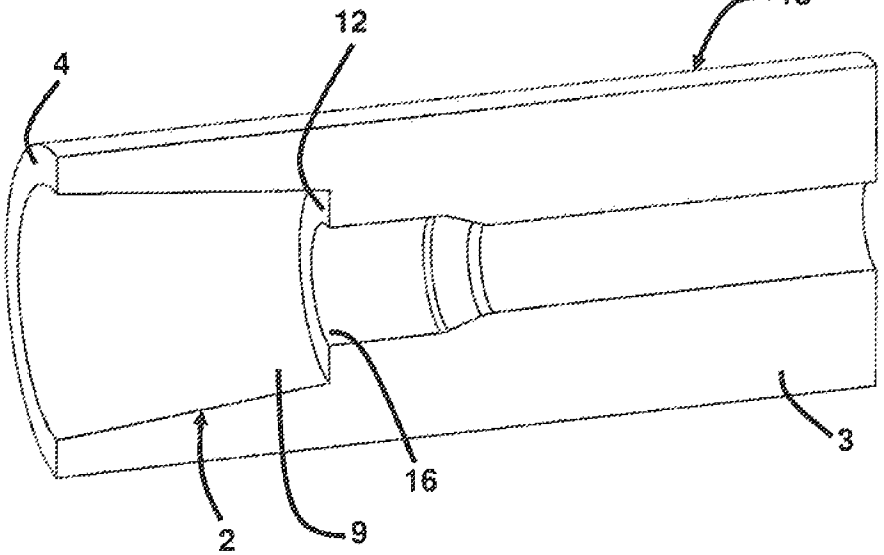
FIG. 8A is a cross-sectional perspective view of an empty chamber without components of the insert of FIGS. 2 through 6B according to an embodiment herein.
Figure 8B:
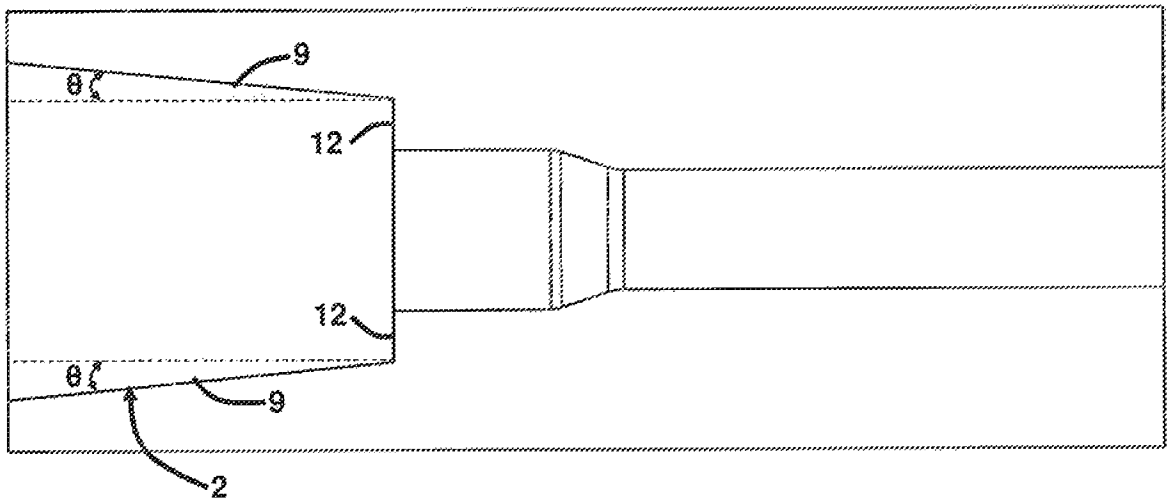
FIG. 8B is a cross-sectional view of the empty chamber of FIG. 8A according to an embodiment herein.

FIGS. 8A and 8B, with reference to FIGS. 2 through 7F, illustrate the collet chamber 2 without the insert 5 or cartridge 10. As a comparison to the conventional chamber shown in FIG. 1, it is evident how the angle θ of the chamber wall 9 is significantly greater than the angle, if any, in the conventional chamber wall 90 shown in FIG. 1. Furthermore, the chamber 2 of the embodiments herein includes a front wall 12, whereas the conventional chamber shown in FIG. 1 includes no such wall since it is not meant to accommodate an insert.

Even though the embodiments herein can be used with conventional pressure cartridge cases for a modest decrease in extraction force, the embodiments herein are particularly well-suited for high pressure cartridge cases. The embodiments herein may also solve the occasional case sticking problems in medium/large caliber weapon systems.

Most small-arms ammunition have a small angular taper along the axis of the cartridge case 10 to help facilitate the loading/removal of the case 10 from the gun chamber 2. This angle is limited to a few degrees so the cartridge cases 10 can feed reliably from a magazine. The embodiments herein provide a way to mimic the easier extraction benefits of an increased cartridge case taper by shifting the larger taper from the ammunition case 10 to tapered chamber wall 9 of the gun chamber 2. The split(s) 1S in the tapered insert 6 allow the wedges 6 to expand radially at the start of extraction of the cartridge case 10, thereby removing the preload of the cartridge case 10 to the chamber 2.

The embodiments herein reduce the amount of force required to remove a spent cartridge case 10 from the chamber 2 of a weapon 13. The embodiments herein provide a movable chamber insert 5 that convert some of the preload of the spent cartridge case 10 into an extraction force $F_R$ due to the geometry of the insert 5 that augments the extraction force required by the extractor. Due to the relatively small taper of the cartridge case, the preload (interference) developed between the cartridge case 10 and the chamber wall 9 take a finite distance to release. The embodiments herein reduce the mechanical preload and the interference between the cartridge case 10 and chamber 2 at a quicker rate (depending on actual geometry) during extraction than the cartridge case 10 alone. Since less force is required to be exerted on the cartridge rim 21 by the extractor, there is less chance of failures of the extractor and cartridge rim 21. The embodiments herein enable the use of high-pressure straight-walled or slightly tapered cartridge cases 10 since they can now be extracted with less force.

Any cartridge ammunition weapon systems including sniper rifles, battle rifles, carbines, anti-material rifles, machine guns, and remotely operated weapons can benefit from the embodiments herein. The embodiments herein can be further extrapolated to medium and large-caliber systems. The insert 5 does not move far enough out of the chamber to "fall out" of alignment. There is sufficient room in the chamber 2 that the wedges 6 can rotate about the bore centerline and shift slightly when no cartridge case 10 is inserted. The wedges 6 can, however, be prevented from rotating and further maintain alignment by means of mechanical means, such as a keyway or alignment pin, but such alignment is not required to achieve the benefits of the insert 5. Once a cartridge case 10 starts to enter the insert 5 and chamber 2, the outside taper 11 of the cartridge case 10 along with the taper of the tapered recess chamber wall 9 maintains axial alignment. The bolt face pushes the inserts forwards (down bore direction) to fully seat the wedges 6 in the tapered recess chamber wall 9.

Almost any weapon firing a cartridge ammunition (from small-arms to artillery) could utilize the embodiments herein. Most existing systems can incorporate the concept with few modifications to existing parts (generally by only modifying the barrels/chambers) and presumably no modifications to ammunition. The next generation of higher performance small-arms platforms are designed for much greater operating pressures, and will need new methods to aid in spent cartridge extraction to achieve weapon cycling reliability, and accordingly the embodiments herein fulfill this need.

The embodiments herein lower the extraction force $F_R$ for commonly available cartridge cases 10 by implementing changes to the gun chamber 2. By incorporating the geometry change into the gun 13, the cost of the ammunition remains the same with only a slight increase in initial cost and complexity of the gun 13. The embodiments herein assume the cartridge case 10 maintains a gas seal against combustion gasses at the mouth of the cartridge case 10, preventing combustion gasses from leaking out of the chamber 2. The embodiments herein can also make use of film lubricants/coatings 19, as indicated in FIG. 5, between the wedges 6 and gun barrel 3 to further enhance cartridge case extraction by lowering friction.

Previous methods of reducing cartridge case extraction force all rely on either reducing the force between the cartridge case and the chamber walls (e.g., fluted chambers) or reducing the coefficient of friction using a film or coating. The embodiments herein explore another avenue by increasing the angle of the normal force on the outside of movable wedges 6 located within the chamber 2, which provides a greater rearward component $F_R$ of the normal force. This force $F_R$ is additive with the force provided by the cartridge case extractor and does not directly rely on lowering friction nor the radial swelling of the case 10.

The embodiments herein provide modifications to existing small-arms weapons 13 that lower the extraction force required to remove a spent cartridge case 10 in preparation for following shots. The embodiments herein do not rely on reducing friction nor reducing mechanical forces associated with the cartridge case 10 in the gun 13, but rather focuses on redirecting the existing mechanical forces to help reduce the extraction force $F_R$. This is achieved by completely redesigning the weapon chamber 10 via a novel assembly 1 comprising of one or more movable wedge-shaped pieces 6 to a barrel chamber 2, with the outside surface 8 of the wedges 6 having a truncated cone shape. Increasing the cone angle provides a greater rearward component of the existing radial expansion force $R_E$ of the cartridge case 10. The embodiments herein address the faults of existing methods to reduce the extraction force by not relying on combustion gas equalization via fluted chambers, which greatly increases soot deposits. Nor do the embodiments herein only rely on lubricating the cartridges or chamber surfaces that can wear off and introduce other complications.

The foregoing description of the specific embodiments will so fully reveal the general nature of the embodiments herein that others can, by applying current knowledge, readily modify and/or adapt for various applications such specific embodiments without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation. Therefore, while the embodiments herein have been described in terms of preferred embodiments, those skilled in the art will recognize that the embodiments herein can be practiced with modification within the spirit and scope of the appended claims.

What is claimed is:

1. A system for reducing an extraction force required for removing a spent munition cartridge case from a weapon after firing, said system comprising: a chamber; and a plurality of movable components not affixed to each other in said chamber that are configured to radially expand with a corresponding expansion of a fired munition cartridge case, wherein radial expansion of said plurality of movable components causes a rearward force on said plurality of movable components and said spent munition cartridge case wherein said chamber comprises a tapered wall, and wherein said plurality of movable components matingly align with said tapered wall, wherein said plurality of movable components align with one another but are not affixed to each other, wherein each movable component comprises a tapered outer surface comprising an angle greater than an angle of an outer surface of a pre-fired cartridge case, wherein said first end of said each movable component is positioned towards a barrel of said weapon, and wherein said second end of said each movable component is positioned towards a rear portion of said chamber.

2. The system of claim 1, wherein said chamber comprises a back wall that abuts said plurality of movable components that are not affixed to each other.

3. The system of claim 1, wherein said plurality of movable components are configured to radially contract and are not affixed to one another.

* * * * *